US010914044B2

(12) United States Patent
Rohde et al.

(10) Patent No.: US 10,914,044 B2
(45) **Date of Patent: *Feb. 9, 2021**

(54) BREAKAWAY GUARDRAIL POST FOR A HIGHWAY CRASH ATTENUATION SYSTEM

(71) Applicant: Safety By Design, Inc., Lincoln, NE (US)

(72) Inventors: John R. Rohde, Whitefish, MT (US); Dean L. Sicking, Indian Springs Village, AL (US); King K. Mak, San Antonio, TX (US); John D. Reid, Lincoln, NE (US)

(73) Assignee: Safety By Design, Inc., Lincoln, NE (US)

( * ) Notice: Subject to any disclaimer, the term of this patent is extended or adjusted under 35 U.S.C. 154(b) by 424 days.

This patent is subject to a terminal disclaimer.

(21) Appl. No.: 15/972,274

(22) Filed: May 7, 2018

(65) Prior Publication Data

US 2019/0338478 A1 Nov. 7, 2019

(51) Int. Cl.
*E01F 15/04* (2006.01)
*E01F 15/14* (2006.01)

(52) U.S. Cl.
CPC ..... *E01F 15/0461* (2013.01); *E01F 15/0423* (2013.01); *E01F 15/146* (2013.01)

(58) Field of Classification Search
CPC . E01F 9/631; E01F 15/00; E01F 15/02; E01F 15/146; E01F 15/0461; E01F 15/023; E01F 15/0438; E01F 15/143; E01F 15/025; E01F 9/644; E01F 15/0415; E01F 15/043; B62D 1/192; G09F 2007/1804; Y10S 248/90
USPC ..... 256/13.1
See application file for complete search history.

(56) References Cited

U.S. PATENT DOCUMENTS

| | | | | |
|---|---|---|---|---|
| 5,775,675 | A * | 7/1998 | Sicking | E01F 15/0476 256/13.1 |
| 5,998,598 | A * | 12/1999 | Csaky | C07K 14/495 435/320.1 |
| 6,308,809 | B1 * | 10/2001 | Reid | F16F 7/125 188/377 |
| 8,448,913 | B1 * | 5/2013 | Rohde | E01F 15/143 248/548 |
| 8,757,597 | B2 * | 6/2014 | James | E01F 15/143 256/13.1 |
| 9,732,484 | B2 * | 8/2017 | Rohde | E01F 15/143 |
| 9,963,844 | B2 * | 5/2018 | Rohde | E01F 15/143 |
| 10,119,231 | B1 * | 11/2018 | Rohde | E01F 15/0492 |
| 2002/0030183 | A1 * | 3/2002 | Albritton | E01F 9/635 256/13.1 |
| 2003/0015695 | A1 * | 1/2003 | Alberson | E01F 15/0461 256/13.1 |
| 2009/0272956 | A1 * | 11/2009 | Abu-Odeh | E01F 15/143 256/13.1 |

* cited by examiner

*Primary Examiner* — Josh Skroupa

(57) ABSTRACT

A highway crash attenuation system having an improved breakaway guardrail post. An improved upper section of Post 1 has an anchor bearing plate with a cooperating stabilizing bolt engaging with the upstream face of the upper post section. The downstream side of the upper post section is provided with split, spaced-apart strut sections which do not obstruct the rear cable pass through notch.

4 Claims, 6 Drawing Sheets

BREAKAWAY GUARDRAIL POST FOR A HIGHWAY CRASH ATTENUATION SYSTEM

BACKGROUND

The present invention relates to improvements to energy absorbing guardrail systems having end terminals, anchor cable release mechanisms, and breakaway posts used in cooperation with longitudinal, sectional barriers. These systems usually extend along highways and roadsides to absorb impact energy and deflect vehicles from hazards which may be associated behind the barriers. The present invention more specifically relates to systems having Box-Beam terminals, sequential kinking terminals (SKT) and flared energy absorbing terminals (FLEAT). More particularly, the present invention relates to an improved breakaway post (Post 1) which facilitates breakaway in head-on impacts while resisting loads on side impacts. Each of these improvements may be incorporated into existing energy absorbing guardrail systems, alone or in combination, to improve the overall safety performance of the systems.

Existing Box-Beam, SKT, and FLEAT terminals depend on the breakaway of Post 1 to release the upstream end of an anchor cable. However, under certain impact conditions, Post 1 may not break away properly, thus not releasing the anchor cable. This in turn could result in snagging and excessively high deceleration of the impacting vehicle. In some cases during an end-on hit, after Post 1 released and lifted the anchor or bearing plate, the assembly got caught under the vehicle resulting in tears in the vehicle's floorboard.

The fact that the cable did not fully separate from the upper section of Post 1 appeared to be the cause of snagging and tearing problems. A present improvement to the first upper section of Post 1 provides a mechanism to positively lift the bearing plate off of the lower section of Post 1 and allow Post 1 to separate from the anchor cable.

In earlier Post 1 designs, Post 1 was intended to breakaway when the post was impacted from a head-on direction, but the post had limited lateral strength. Thus, for side impacts just downstream of Post 1, the earlier Post 1 design sometimes resulted in unintentional break away allowing the impacting vehicle to gate through the terminal and go behind the guardrail installation. An embodiment of the present invention provides for an improved post design that still allows Post 1 to break away in head-on impact, while providing added lateral strength to accommodate side impacts just downstream of Post 1.

An alternative embodiment of the present invention utilizes the anchor cable release bracket disclosed and claimed in U.S. Pat. No. 8,448,913, but utilizes an improved upstream anchor cable release mechanism.

BRIEF DESCRIPTION OF THE DRAWINGS

FIG. 2$C^1$ shows a top side view of the lower post section.

FIG. 2$C^2$ illustrates a bottom side view of the lower post section.

FIG. 2$C^3$ shows a side elevation view of the lower post section.

FIG. 3D is a top view of the upper post section of FIG. 3C showing the spaced-apart sections of the lateral support lip with a space therebetween for an anchor cable to pass through.

FIG. 4$A^1$ a detailed view of the components of the improved breakaway post of FIG. 4A.

DETAILED DESCRIPTION OF A PREFERRED EMBODIMENT

Figure 1A:
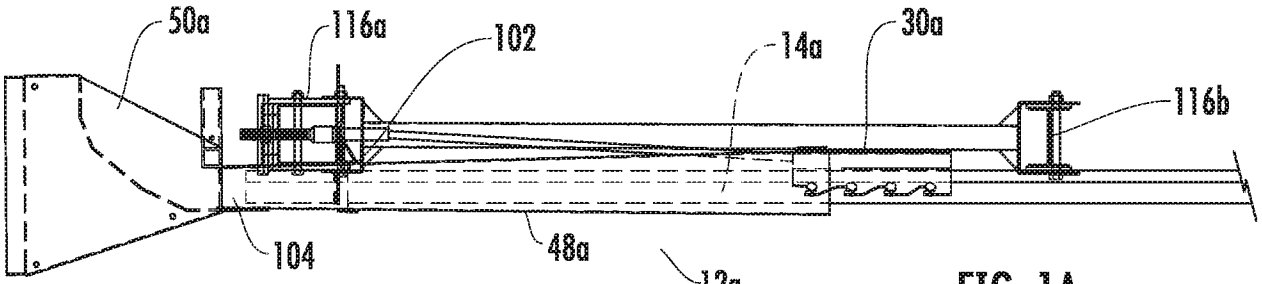
FIG. 1A shows a top plan view of the terminal of FIG. 1.
Figure 1:
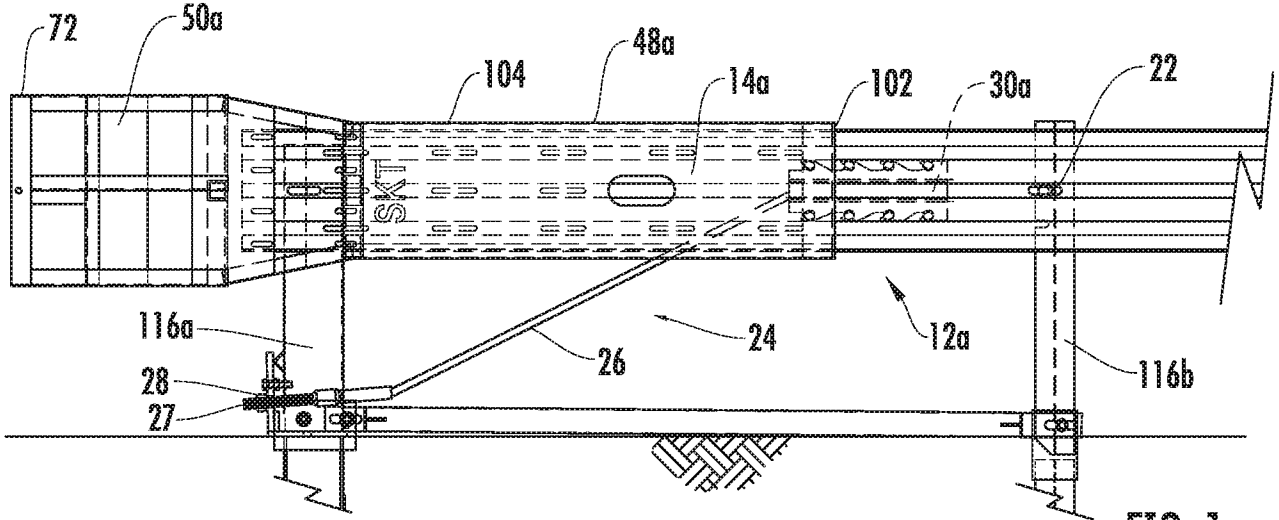
FIG. 1 illustrates a side elevation view of an SKT highway guardrail terminal system having the improved breakaway guardrail post of the present invention.

Referring now to the drawings, and more particularly to FIG. 1, the reference numerical 12*a* generally represents an SKT energy dissipating guardrail terminal with the improved breakaway guardrail post of the present invention. The terminal is adapted to be connected to the upstream side of a conventional guardrail 14*a* consisting of standard W-beam guardrail sections. The guardrail sections or rail elements are attached along their vertical axes V by bolts 22 to a plurality of spaced apart vertical breakaway posts 116*a*-116*b*. Any suitable number of posts may be used depending upon the expanse of the guardrail run. FIG. 1 illustrates two steel breakaway posts 116*a* and 116*b*. Steel posts downstream from lead posts 116*a* and 116*b* may be embedded directly into the soil.

FIG. 1 further illustrates the anchor cable mechanism 24 which includes an anchor cable 26, a lower anchor cable bolt 28, and an anchor cable release bracket 30*a*. The anchor cable mechanism 24 is provided to allow the terminal to withstand angular vehicle impacts downstream of its upstream end.

Figure 2A:
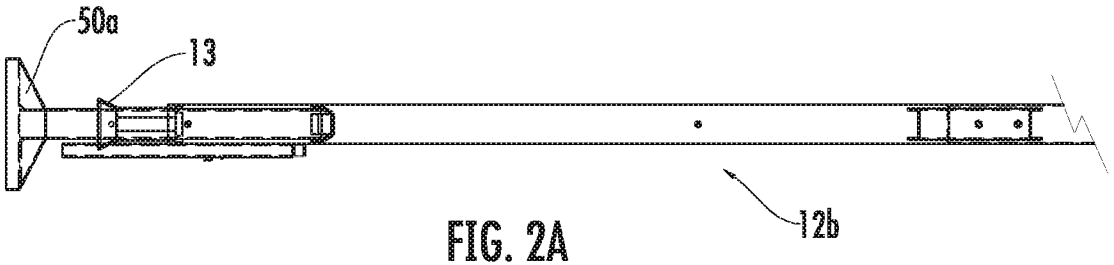
FIG. 2A shows a top plan view of the terminal of FIG. 2.
Figure 2:
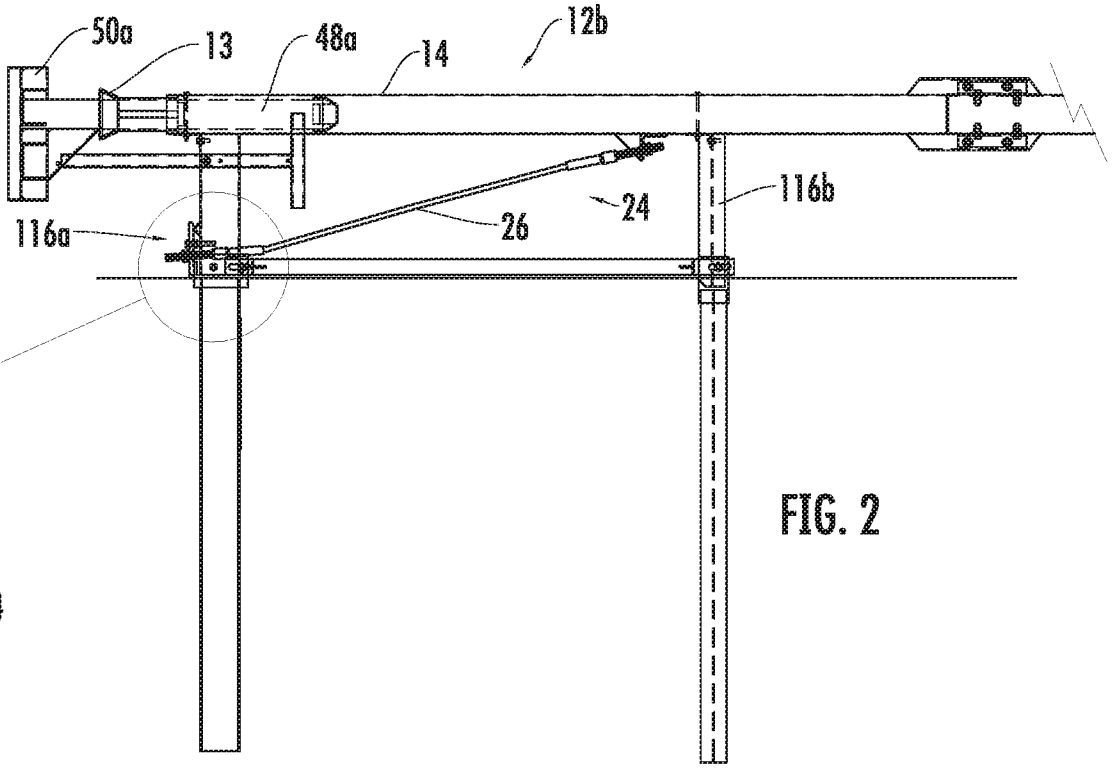
FIG. 2 illustrates a side elevation view of a Box-Beam highway guardrail terminal having the improved breakaway guardrail post of the present invention.

FIGS. 2 and 2A show a Box-Beam bursting energy absorbing terminal with the improved breakaway guardrail post of the present invention.

It is intended that a vehicle will impact the guardrail downstream of its upstream end; however, a collision with the upstream end requires the provision of an end treatment to reduce the extent of injury to the impacting vehicle and its occupants. The purpose of the end treatment is to dissipate impact energy of the vehicle. There are a number of existing prior art treatments which are compatible with the instant invention, including, but not limited to, the Box-Beam terminal, sequential kinking terminal (SKT), and other bursting energy terminal (BEAT).

As seen in FIGS. 1 and 1A, the impact head portion 50*a* of the end treatment is attached on the upstream end 104 of a guide tube or feeder chute 48*a*. Guide tube 48*a* is mounted onto improved breakaway lead post 116*a* by fasteners passing through post angle brackets. The upstream end of the W-beam rail element 14*a* extends into the upstream end 104 of guide tube 48*a*. Guide tube 48*a* has an anchor bracket impact shoulder 102 with a leading tapered edge which impacts with the upstream end of anchor cable release bracket 30*a* when the impact head 50*a* is urged downstream upon a vehicular impact.

When the end treatment is impacted end-on by an errant vehicle, an impact plate 72 will engage and interlock mechanically with the front of the vehicle. As the vehicle proceeds forward, the impact head 50*a* will be moved forward or downstream along the W-beam rail element 14*a*. Improved breakaway Post 116*a* is provided with a hole though which passes the upstream end of the anchor cable 26 of an anchor cable mechanism 24. When the impact head is displaced downstream in a collision, post 116*a* will snap or break as discussed below, thus releasing the tension on the cable 26 of the anchor cable mechanism 24 at this upstream location.

At or shortly after breaking the lead post 116*a*, the upstream end of the W-beam rail element 14*a* will be treated within the impact head to dissipate impact energy. As the vehicle proceeds forward and pushes the impact head 50*a* along, the downstream end of the guide tube/feeder chute 48*a* reaches the upstream end of anchor cable release bracket 30*a* on the rail element 14*a*. The anchor cable release bracket 30*a*, which is held on the W-beam rail element 14*a* by the anchor cable release bracket attachment bolts, will be pushed forward, slide off the bolts, rotate out of parallel alignment with and be released from the W-beam rail element 14*a*. This process is fully described in U.S. Pat. No. 8,448,913, which is incorporated herein for all purposes.

FIG. 1A is a top view of the FIG. 1 highway guardrail system with the improved breakaway guardrail post 116*a*. Details of the structure and operation of the prior art cable release mechanism are taught and disclosed in U.S. Pat. No. 8,448,913 B1 issued May 28, 2013, which disclosure is incorporated herein for all purposes.

Turning now to FIGS. 2 and 2A, a Box-Beam terminal system 12*b* is shown with an improved breakaway guardrail post 116*a*. U.S. Pat. No. 6,308,809, which is incorporated herein for all purposes, teaches a crash attenuation system which uses a controlled fracture mechanism. FIG. 2 illustrates a side elevation view of such a crash attenuation system mounted on guardrail posts 116*a* and 116*b*. The attenuation system has an anchor cable release mechanism 24 which cooperates with improved breakaway guardrail post 116*a* to control the rotation of the upper post section 200 off of the lower post section 202 as discussed below.

The Box-Beam terminal 12*b* has a controlled fracture or rupturing mechanism wherein an oversized plunger with a tapered surface (mandrel 13) is forced into a thin-wall tubing 14 of the generally same shape whereby pressure is exerted on the edges of the tubing from inside. The pressure initially expands the size of the thin-wall tubing, first elastically until the yielding strength of the material of the tube is reached and then plastically. The tubing eventually fractures or ruptures at the edge when the ultimate tensile capacity of the material is exceeded. This process of fracturing the tubing dissipates energy as the mandrel proceeds downstream.

Figure 2B:
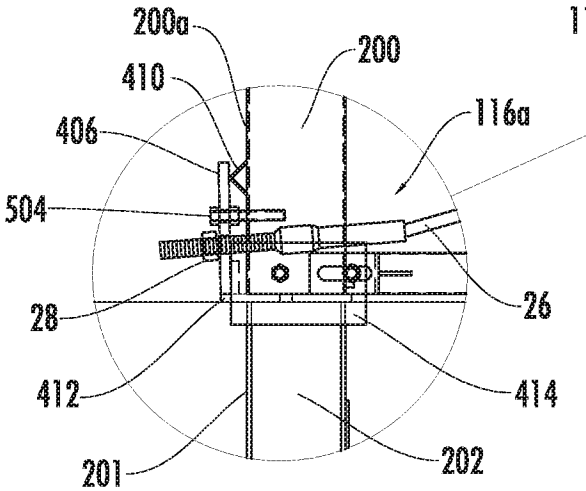
FIG. 2B illustrates a detailed view of the improved breakaway post of the present invention in a first aligned position prior to impact.

FIG. 2B illustrates the components of the improved breakaway post 116*a* used with highway crash systems relying upon a lead breakaway post having an upper post section 200 and a lower post section 202. FIG. 2B shows the post 116*a* in a first aligned position.

As may be seen in FIG. 2B, lead post 116*a* has an upper post section 200 provided with a angle iron spacer 410 on the upstream face 200*a* of post section 200. The spacer 410 is a section of angle iron joined with the upstream face 200*a* of the upper section 200 of post 116*a*. The angle iron spacer 410 acts to keep space between anchor bearing plate 406 and the upper post section 200. The angle iron spacer 410 enhances engagement of the bearing plate 406 with the lower post section 202. The size of the angle iron spacer 410 urges the bearing plate 406 to assume a predetermined angle (angle range of 0° to 70°) from the vertical. This predetermined angle significantly reduces the propensity of the bearing plate 406 to slip up and off the lower post section 202 during a redirective impact where the load is applied via the cable 26 to the bearing plate 406.

FIG. 2B also shows an L-shaped ledge or shelf 412 extending from the upstream face 201 of lower post section 202 upon which a lower edge of the bearing plate 406 rests atop of the ledge 412 to mitigate the rotation of the bearing plate 406, which may reduce the anchorage capacity of the system.

Figure 2C:
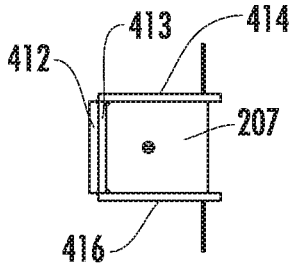
FIG. 2C illustrates a side elevation view of the lower post section showing a ledge or shelf on the upstream face of the post section.
Figure 2C:
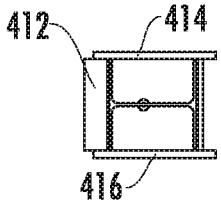
Figure 2C:
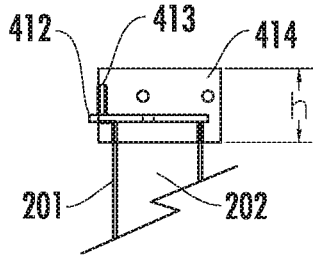
Figure 2C:
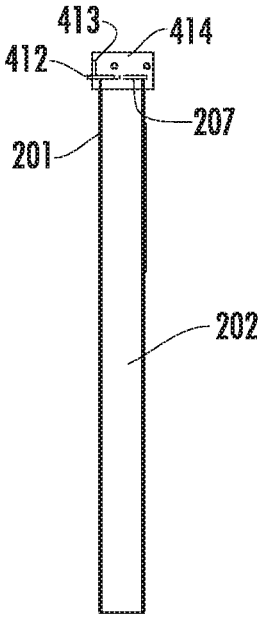

FIG. 2C illustrates that the top 207 of the lower post section 202 extends upstream of the face 201 of the lower post section to provide the ledge or shelf 412. FIGS. 2$C^1$-2$C^3$ illustrate top side (FIG. 2$C^1$), bottom side (FIG. 2$C^2$), and side elevation views (FIG. 2$C^3$), respectively, of lower post section 202 showing the relationship of the ledge 412 and side walls 414 and 416. A vertical cross-member 413 extends horizontally along an upstream portion of the top to complete the L-shaped shelf 412.

Additionally, FIGS. 2C-2$C^3$ illustrate that the height h (FIG. 2$C^3$) of opposing, upwardly-extending side plates 414 and 416 on the top 207 of the lower post section 202 are raised to a location above the centerline of an anchor cable locking nut 28 (see FIGS. 1, 2B, 3F, and 4$A^3$) affixed to the upstream-most end of the anchor cable 26 when the cable 26 passes through through hole 29*b* in plate 406, through through notch 225 and notch 227 in upper post section 200 (see FIG. 2D and FIGS. 3A-3F).

Figure 3E:
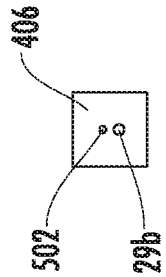
FIG. 3E illustrates the anchor bearing plate used in association with the upper post section showing the stabilizing bolt hole and the anchor cable through pass hole.
Figure 3D:
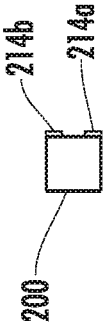
Figure 3C:
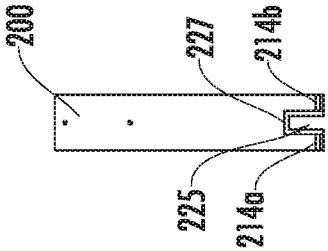
FIG. 3C shows a rear elevation view of the upper section of the improved breakaway position of FIG. 3A showing a rear notch and the spaced apart section of lateral support lips extending along the lower edge of the downstream face of the upper section. The spaced-apart lip sections have a space therebetween such that the rear notch opening is unobstructed.
Figure 3B:
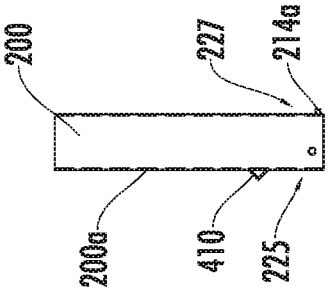
FIG. 3B illustrates a side elevation view of the upper section of the improved breakaway post showing an angle iron spacer on the upstream side of the post section and a section of lateral support lip or strut along a lower edge of the downstream face of the upper post section.
Figure 3A:
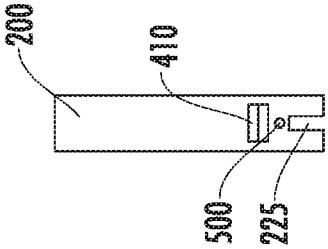
FIG. 3A illustrates a front elevation view of the upper section of the improved breakaway post showing a front, lower anchor cable pass through notch, an angle iron spacer, and anchor stabilizing bolt hole.
Figure 3:
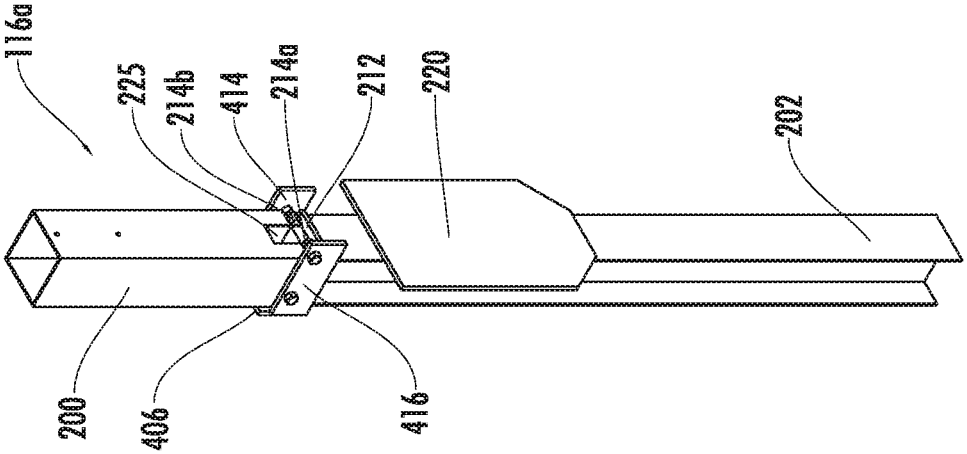
FIG. 3 shows a downstream perspective view of the improved breakaway post of the present invention in a first aligned position.

FIG. 3 shows a downstream perspective view of the improved post 116*a* in a first aligned position with upper post section 200 atop of lower post section 202 between side walls 414 and 416. An anti-twist plate 220 is affixed to the downstream face of lower post section 202. As stated previously, this improved post may be used with any terminal which requires a lead breakaway post.

FIG. 3A illustrates a front elevation view of the improved upper section 200 of post 116*a*, showing a front, lower anchor cable pass through notch 225, an angle iron spacer 410 affixed to the upstream face 200*a* of upper section 200, and an anchor stabilizing bolt hole 500.

To provide the positive release of the bearing plate 406 (FIG. 3F), an additional anchor bolt stabilizing hole 502 is provided through the bearing plate 406 (FIG. 3E). An anchor plate stabilizing bolt 504 (FIG. 3F) may be secured in a manner that protrudes into the stabilizing hole 500 on the upstream face of post section 200 (FIG. 3F).

Figure 3F:
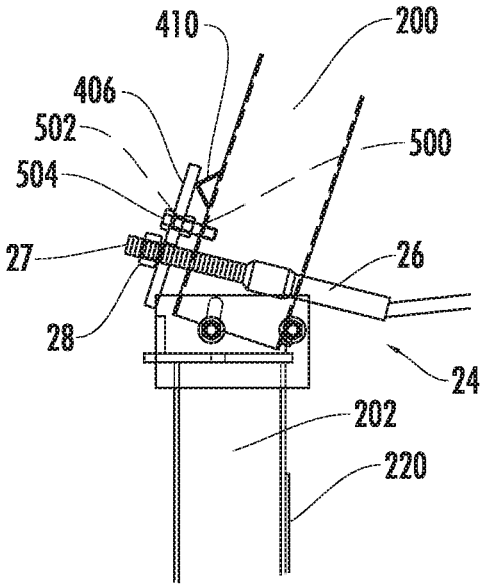
FIG. 3F illustrates a side elevation view of the improved breakaway guardrail post with the upper section in rotation and lifting of the lower post section upon a head-on impact.

In an end-on impact, the engagement of bolt 504 with the hole 500 in post section 200 lifts the bearing plate 406_off of lower section 202 of post 116*a* as illustrated in FIG. 3F. This improvement involving the cooperation of the bolt 504 with the hole 500 in upper post section 200 allows upper section 200 of post 116*a* and the bearing plate 406 to be free to detach, reducing the bulk of the anchor cable mechanism 24. Crash testing with this modified arrangement was successful with no damage to the floor pan of the impacting vehicle.

FIG. 3B shows a side elevation view of a modified upper post section 200 with angle iron spacer 410 on the upstream face of section 200. On the downstream face at the bottom of the section 200 is a rear strut section 214*a*. FIG. 3D shows, from a top view, two, spaced-apart rear strut sections (214*a* and 214*b*) along the base of the section 200. It was found that the strut did not need to extend along the entire downstream face, but that the two, spaced-apart strut sections 214*a* and 214*b* still engage the lower post section 202 and function effectively.

The spaced-apart sections 214*a* and 214*b* may be seen in FIG. 3C along the lower bottom edge of the upper post section 200. Further, FIG. 3C shows the cable pass through slots or notches 225 (in the upstream face of upper post section 200) and 227 (in the downstream face of upper post section 200).

An anchor bearing plate 406 is illustrated in FIG. 3E. The additional stabilizer bolt hole 502 is shown above the cable hole 29*b*.

FIG. 3F is similar to FIG. 2B, except that it illustrates the anchor mechanism 24 with the stabilizing bolt 504 passing through the bearing plate 406 and into the upstream face of upper section 200 of post 116*a* as upper post section 200 rotates and lifts off lower section 202 upon impact.

Figure 4B:
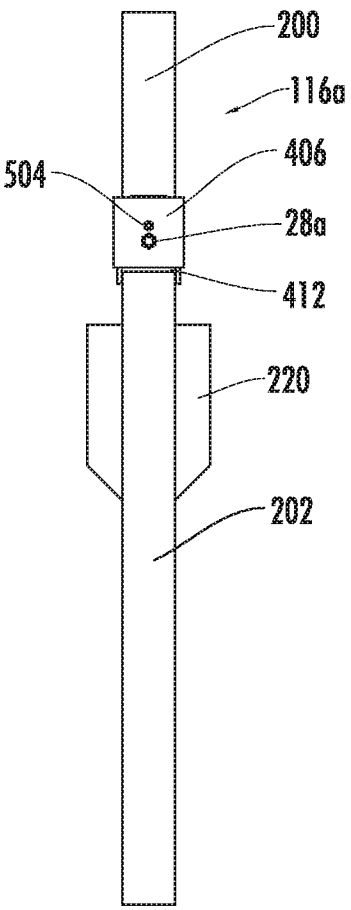
FIG. 4B shows the anchor bearing plate of the improved breakaway post preventing lateral rotation of upper section in relation to lower section.
Figure 4A:
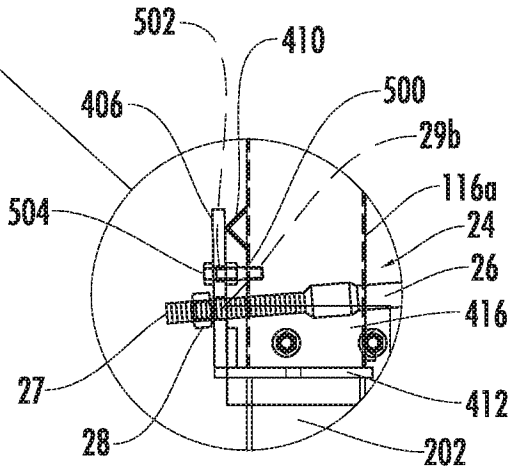
FIG. 4A illustrates a side elevation view of the improved breakaway post 116*a*.
Figure 4A:
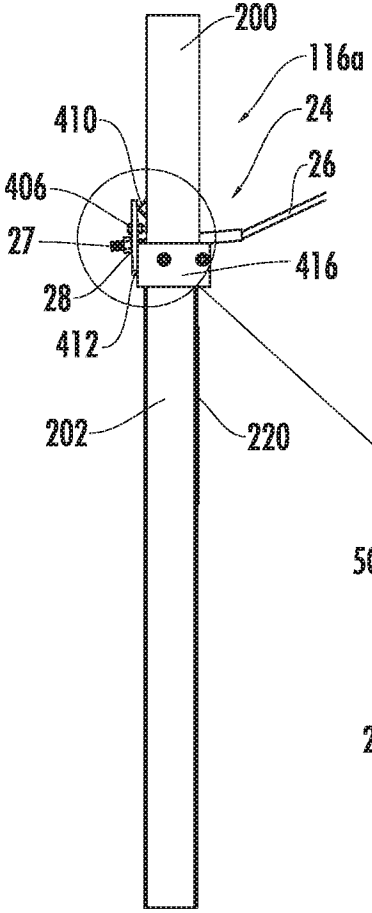

FIGS. 4A, 4A$^1$, and 4B illustrate how anchor bearing plate 406 cooperates with ledge 412 to avoid lateral rotation of the plate 406. The stabilizing bolt 504 further enhances the avoidance of rotation of the plate 406. The reference numerals in FIGS. 4A, 4A$^1$, and 4B are consistent with those used in the above discussion. The guardrail post 116*a* has an upper post section 200, a lower post section 202, an anti-twist plate 220 on the downstream face of lower post section 202.

The embodiments described herein are some examples of the current invention. Various modifications and changes of the current invention will be apparent to persons of ordinary skill in the art. Among other things, any feature described for one embodiment may be used in any other embodiment. The scope of the invention is defined by the attached claims and other claims to be drawn to this invention, considering the doctrine of equivalents, and is not limited to the specific examples described herein.

What is claimed is:

1. A highway crash attenuation system having an improved breakaway guardrail post said post comprising:

an upper post section and a lower post section, said upper post section having a first anchor cable through notch in an upstream wall of said upper post section and a second anchor cable through notch in a downstream wall of said upper post section, and an anchor cable passing through said first notch in said upstream wall and said second notch in said downstream wall;

spaced-apart sections of lateral support lips extending along a lower edge of a downstream face of said upper post section, said spaced-apart support lip sections having a space therebetween such that a cable passes through opening in said second notch is unobstructed;

a cable anchor bearing plate engaged with an upstream face of said upper post section, said bearing plate having a first anchor cable through hole through which an anchor cable is adapted to pass and be retained therein by a locking nut affixed to an upstream most end of said anchor cable, wherein said bearing plate is disposed at a predetermined angle with respect to said first breakaway post by engaging a spacer between a top end of said plate and an upstream face of said upper post; and an anchor bearing stabilizing bolt extending through a second hole in said bearing plate and secured in a stabilizing hole in said upstream face of said upper post section.

2. The highway crash attenuation system of claim 1, wherein said spacer is a section of angle iron joined with said upstream face of said upper section of said post.

3. The highway crash attenuation system of claim 1, further comprising: a ledge on top of said lower section of said post, said ledge extending under said cable anchor bearing plate to provide a shelf for supporting said bearing plate and preventing rotation of said cable anchor bearing plate.

4. The highway crash attenuation system of claim 3, wherein said upstream-most end of said anchor cable remains retained by said cable anchor bearing plate after vehicular impact separating said upper post section from said lower post section.

* * * * *